US007809322B2

(12) United States Patent
Takeuchi et al.

(10) Patent No.: US 7,809,322 B2
(45) Date of Patent: Oct. 5, 2010

(54) IMAGE FORMING APPARATUS AND PROCESS CARTRIDGE THEREFORE HAVING A CLEANER SECTION WHICH STORES UNUSED DEVELOPER

(75) Inventors: Nobutaka Takeuchi, Yokohama (JP); Nobuo Iwata, Sagamihara (JP); Satoshi Muramatsu, Edogawa-ku (JP); Junichi Matsumoto, Yokohama (JP); Takayuki Koike, Yokohama (JP); Eriko Maruyama, Sagamihara (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 12/243,535

(22) Filed: Oct. 1, 2008

(65) Prior Publication Data

US 2009/0041520 A1 Feb. 12, 2009

Related U.S. Application Data

(62) Division of application No. 11/130,146, filed on May 17, 2005, now Pat. No. 7,444,107.

(30) Foreign Application Priority Data

May 17, 2004 (JP) ..... 2004-145919

(51) Int. Cl.
*G03G 21/00* (2006.01)

(52) U.S. Cl. ..... 399/359; 399/258

(58) Field of Classification Search ..... 399/359, 399/355, 350, 356, 343, 258, 120
See application file for complete search history.

(56) References Cited

U.S. PATENT DOCUMENTS 3,700,328 A * 10/1972 Davidge et al. ..... 399/359
4,006,987 A 2/1977 Tomono et al.
4,515,467 A 5/1985 Suzuki
4,768,055 A * 8/1988 Takamatsu et al. ..... 399/359
4,873,551 A 10/1989 Tajima et al.
6,507,720 B2 1/2003 Kabumoto et al.
6,628,908 B2 9/2003 Matsumoto et al.
6,628,915 B2 9/2003 Muramatsu et al.
6,665,511 B2 12/2003 Takeuchi et al.
6,826,381 B2 11/2004 Muramatsu et al.
6,856,780 B2 2/2005 Kadota et al.
2003/0104297 A1 6/2003 Matsuda et al.
2003/0235436 A1 12/2003 Kasahara et al.

(Continued)

FOREIGN PATENT DOCUMENTS

EP 249928 A2 12/1987

(Continued)

*Primary Examiner*—David M Gray
*Assistant Examiner*—Laura K Roth
(74) *Attorney, Agent, or Firm*—Oblon, Spivak, McClelland, Maier & Neustadt, L.L.P.

(57) ABSTRACT

An image forming apparatus, using a developer including toner particles and carrier particles, includes a developing unit, a cleaning unit, and a conveying unit. The developing unit contains the developer and develops an electrostatic latent image formed on an image carrying member as a toner image with the toner particles. The cleaning unit contains the developer and mixes the developer with the toner particles collected from the image carrying member after transferring the toner image. The conveying unit conveys a mixture of the collected toner particles and the developer from the cleaning unit to the developing unit.

11 Claims, 5 Drawing Sheets

U.S. PATENT DOCUMENTS

| | | | |
|---|---|---|---|
| 2004/0013963 | A1 | 1/2004 | Muramatsu et al. |
| 2004/0131392 | A1 | 7/2004 | Matsumoto et al. |
| 2004/0247343 | A1 | 12/2004 | Matsumoto et al. |
| 2004/0265014 | A1 | 12/2004 | Takeuchi et al. |
| 2004/0265015 | A1 | 12/2004 | Koike et al. |
| 2005/0025527 | A1 | 2/2005 | Matsumoto et al. |
| 2005/0089347 | A1 | 4/2005 | Muramatsu et al. |

FOREIGN PATENT DOCUMENTS

| | | |
|---|---|---|
| JP | 58-147771 | 9/1983 |
| JP | 2001-125447 | 5/2001 |
| JP | 2002-014588 | 1/2002 |
| JP | 2003-345205 | 12/2003 |

* cited by examiner

IMAGE FORMING APPARATUS AND PROCESS CARTRIDGE THEREFORE HAVING A CLEANER SECTION WHICH STORES UNUSED DEVELOPER

CROSS REFERENCE TO RELATED APPLICATIONS

This application is a division of U.S. Ser. No. 11/130,146, filed May 17, 2005, now U.S. Pat. No. 7,444,107 and claims priority to Japanese Patent Application No. 2004-145919, filed May 17, 2004, the entire contents of both of which are incorporated herein.

BACKGROUND OF THE INVENTION

1. Field of the Invention

The following disclosure relates generally to an image forming apparatus configured to re-use toner particles.

2. Discussion of the Background

Conventionally, a monochrome image forming apparatus such as monochrome copier and monochrome printer is configured to collect toner particles remaining on a photoconductive drum (i.e., image carrying member) after a transfer process with a cleaning unit, and to supply the collected toner to a developing unit to re-use the collected toner particles in view of resource saving and longer lifetime of the image forming apparatus. Some background apparatuses use a method that a cleaning unit collects not-transferred toner particles by a cleaning unit, and such not-transferred toner particles are conveyed to a toner refining unit, then separated by a magnet roller in the toner refining unit, and conveyed to a developing unit. Other background apparatuses use a method in which a two-component developer stored in a developing unit is circulated between the developing unit and a cleaning unit. Toner particles collected in the cleaning unit are mixed with the circulating developer, and used as "recycled toner."

As for color image forming apparatuses, such as color copiers and color printers, there is a need for apparatuses that can stably produce high quality images even if some environmental conditions are changed. Such color image forming apparatuses have employed a two-component developing method using a two-component developer having non-magnetic toner particles and magnetic carrier particles.

As for the two-component developing method, a developing roller (i.e., developer carrier) having a magnet inside the developing roller is applied with a predetermined developing bias voltage. At this time, the magnetic carrier particles aggregate on the developing roller along magnetic field lines formed around the magnet to form a magnetic brush. The non-magnetic toner particles adhere to the magnetic brush. With such an arrangement, the two-component developer is carried on the developing roller, and the non-magnetic toner particles in the two-component developer are transferred and adhered on an electrostatic latent image formed on a photoconductive drum.

The above-mentioned background apparatuses experience image quality degradation such as background fogging and degraded granular quality over time. Therefore, using the toner particles collected by the above-mentioned background apparatuses as "recycled toner" is unfavorable for the color image forming apparatus in view of stably producing high quality images. Specifically, the two-component developer used for color image forming apparatuses typically includes additives on a surface of toner particles such as silica and titanium oxide in order to improve dispersibility of toner particles. Theses additives are susceptible to mechanical stress and heat stress, thereby the additives may be buried inside the toner particles, or may be dropped off from the surface of toner particles when an agitator agitates the developer in the developing unit, which can result in a change of properties (e.g., fluidity) of the developer. Accordingly, the amount of developer to be carried-up to a developing area of the developing roller may be reduced, thereby causing image quality degradation such as lower granular quality.

Such a drawback can be observed when the collected toner particles are used as "recycled toner." Specifically, the collected toner particles, which are collected in the cleaning unit, may receive stresses such as mechanical stress and heat stress when the collected toner particles are conveyed to the developing unit from the cleaning unit, whereby the additives on the toner particles may be buried inside the toner particles, or may be dropped off from the surface of toner particles.

Furthermore, the collected toner particles in the cleaning unit may have unstable charge properties (e.g., charge rising property) due to a transfer bias voltage applied during a transfer process. Such toner particles may not regain stable charge properties even if such toner particles are mixed with the developer in the developing unit. When such toner particles are used as "recycled toner," such toner particles may not adhere to carrier particles properly, thereby the toner particles may spatter in the developing unit, or may adhere on a non-image area of the photoconductive drum and form a background fogging in a printed image.

Such drawbacks may become more obvious if the carrier particles in the developing unit are used for a longer time and lower its charge-ability (hereinafter referred as "CA") for the toner particles.

The above-mentioned background apparatuses use methods that collect toner particles in the cleaning unit and convey the collected toner particles to the developing unit via the toner refining unit. Accordingly, when such collected toner particles are conveyed in a conveying line, these toner particles receive stresses such as direct mechanical stress from conveying unit members and from collisions with other toner particles. In such conditions, the additives may be buried in the toner particles or dropped from the toner particles, and toner particles may aggregate, or change their charge property. As a result, image quality degradation such as toner particles spattering, background fogging, and lower granular quality may happen. Such drawbacks may become further obvious if the carrier particles in the developing unit degrade over time.

On one hand, such a background apparatus circulates the two-component developer stored in the developing unit between the developing unit and the cleaning unit, and mixes toner particles collected in the cleaning unit with the circulating developer. Therefore, when the collected toner particles are conveyed in a circulating line, the collected toner particles receive a lower stress such as direct mechanical stress from members composing a conveying unit and from collisions with other toner particles. However, if the carrier particles in the circulating developer degrade over time, image quality degradation such as toner particles spattering, background fogging, and lower granular quality may happen. In addition, the amount of impurities such as dropped additives and paper powders may increase in the circulating line over time, whereby such impurities may affect the properties of the developer, and result in an unstable developing process.

SUMMARY OF THE INVENTION

The present disclosure relates to an image forming apparatus which uses a developer including toner particles and carrier particles and includes a developing unit, a cleaning unit, and a conveying unit. The developing unit contains the developer and develops an electrostatic latent image formed on an image carrying member as a toner image with the toner particles. The cleaning unit contains the developer and mixes the developer with the toner particles collected from the image carrying member after transferring the toner image. The conveying unit conveys a mixture of the collected toner particles and the developer from the cleaning unit to the developing unit.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
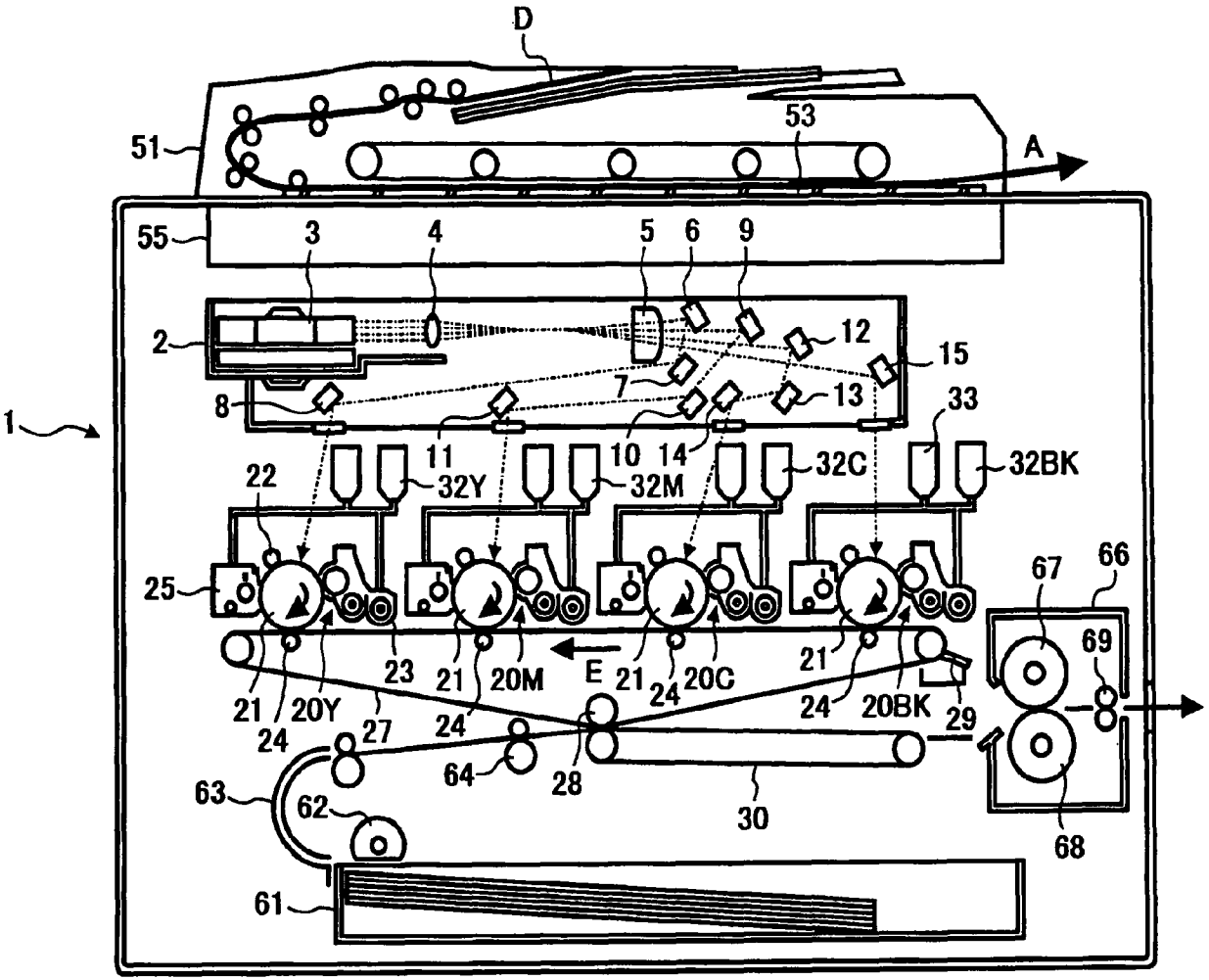
FIG. 1 is a schematic view of an image forming apparatus according to one embodiment of the present invention.

Referring now to the drawings, wherein like reference numerals designate identical or corresponding parts throughout the several views.

In describing embodiments illustrated in the drawings, specific terminology is employed for the sake of clarity. However, the disclosure of this present invention is not intended to be limited to the specific terminology so selected and it is to be understood that each specific element includes all technical equivalents that operate in a similar manner.

The following disclosure describes an invention that generally relates to image forming apparatuses such as copiers, printers, facsimiles, or multifunctional apparatuses, for example, having at least one combination of these devices. The disclosure describes an invention that generally relates to an image forming apparatus utilizing a two-component developer and having a process cartridge, a developing unit, and a cleaning unit, which are configured to re-use toner particles.

Referring now to the drawings, where like reference numerals designate identical or corresponding parts throughout the several views, and more particularly to FIGS. 1-4 thereof, an image forming apparatus according to an exemplary embodiment is described.

As shown in FIG. 1, an image forming apparatus 1 includes an optical writing unit 2, process cartridges 20Y, 20M, 20C, and 20BK, a first transfer roller 24, an intermediate transfer belt 27, a second transfer roller 28, a belt-cleaning unit 29, a transport belt 30, toner bottles 32Y, 32M, 32C, and 32BK, a carrier bottle 33, a document feeder 51, a document reader 55, a sheet feeder 61 storing a transfer member "P", and a fixing unit 66.

The document feeder 51 feeds a document "D" to the document reader 55. The document reader 55 scans image information on the document "D".

The optical writing unit 2 includes a polygon mirror 3, lenses 4 and 5, mirrors 6 to 15, and emits laser beams according to image data scanned by the document reader 55.

Each of the process cartridges 20Y, 20M, 20C, and 20BK is used for forming a yellow image, a magenta image, a cyan image, and a black image, respectively. Each of the process cartridges 20Y, 20M, 20C, and 20BK includes a photoconductive drum 21 (i.e., image carrying member), a charger 22, a developing unit 23, a drum-cleaning unit 25, and a conveying line 26 (see FIG. 2). Each of the toner bottles 32Y, 32M, 32C, and 32BK supplies respective color toner to the developing unit 23.

The charger 22 charges a surface of the photoconductive drum 21. The developing unit 23 develops an electrostatic latent image formed on the photoconductive drum 21 as a toner image. The first transfer roller 24 transfers the toner image formed on the photoconductive drum 21 to the intermediate transfer belt 27. The drum-cleaning unit 25 collects toner particles remaining on the photoconductive drum 21.

In a configuration shown in FIG. 1, the intermediate transfer belt 27 receives the toner image from the photoconductive drum 21. The second transfer roller 28 transfers the toner image formed on the intermediate transfer belt 27 to the transfer member "P". The belt-cleaning unit 29 collects toner particles remaining on the intermediate transfer belt 27. The transport belt 30 transports the transfer member "P", which receives the toner image.

The sheet feeder 61 stores the transfer member "P" such as transfer sheet. The fixing unit 66 fixes the toner image on the transfer member "P".

Figure 2:
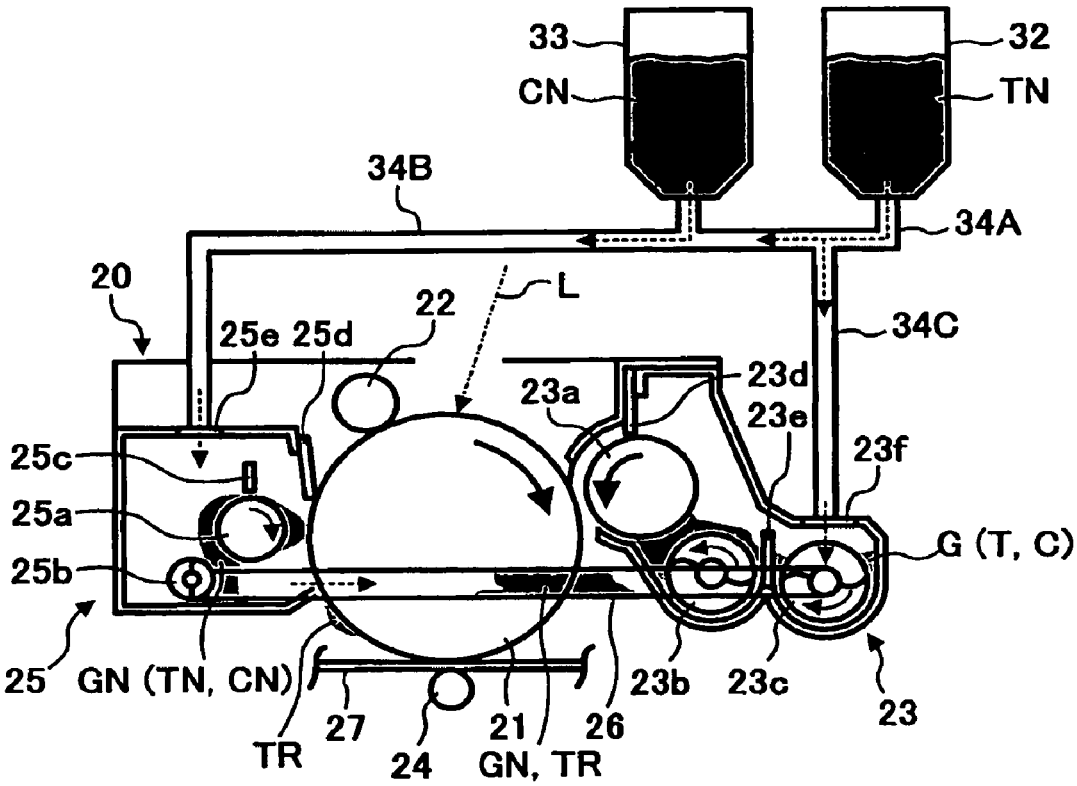
FIG. 2 is a schematic sectional view of a process cartridge of the image forming apparatus depicted in FIG. 1.
Figure 3:
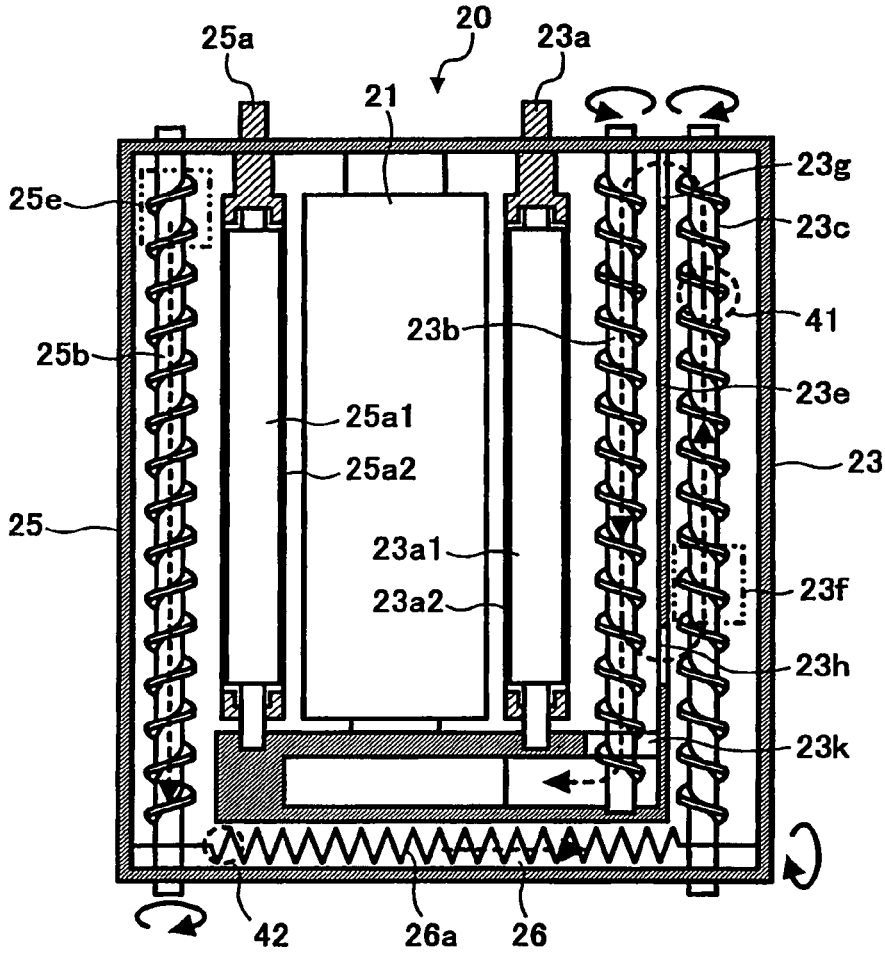
FIG. 3 is another schematic sectional view of the process cartridge depicted in FIG. 2.

As shown in FIGS. 2 and 3, each of the process cartridges 20Y, 20M, 20C, and 20BK integrates the photoconductive drum 21, the charger 22, the developing unit 23, the drum-cleaning unit 25, and the conveying line 26. Each of the process cartridges 20Y, 20M, 20C, and 20BK can be detached from the image forming apparatus 1 for a recycling with a predetermined period. Each of the process cartridges 20Y, 20M, 20C, and 20BK conducts a respective image forming (i.e., yellow, magenta, cyan, and black image forming) on the photoconductive drum 21.

The image forming apparatus 1 conducts an image forming operation as described below.

As shown in FIG. 1, the document feeder 51 feeds the document "D" in an arrow direction "A" by using feed rollers, and places the document "D" on a contact glass 53 of the document reader 55. The document reader 55 optically scans image information of the document "D" placed on the contact glass 53. The document reader 55 optically scans images on the document "D" using a light beam emitted from a light source (not shown). The light beam reflected on the document "D" is focused on a color sensor (not shown) via mirrors (not shown) and lenses (not shown).

Color image information of the document "D" is decomposed to R, G, and B (i.e., red, green, blue) signals, and converted to electrical signals corresponding to the respective colors of R, G, and B at the color sensor. The electrical signals corresponding to the respective colors receive a color-conversion process at an image processing unit (not shown) based on an intensity of the signals to generate color image information for yellow, magenta, cyan, and black. Then, the color image information for yellow, magenta, cyan, and black is transmitted to the optical writing unit 2.

The optical writing unit 2 emits respective laser beams to the respective photoconductive drums 21 of the process cartridges 20Y, 20M, 20C, and 20BK based on the color image information. The laser beam "L" reflected at the polygon mirror 3 passes through the lenses 4 and 5. The laser beam "L" passes through the lenses 4 and 5 and is then split based on the color image information of yellow, magenta, cyan, and black, and the laser beams for the respective colors (i.e., yellow, magenta, cyan, and black) are emitted to the photoconductive drum 21 of the respective process cartridges 20Y, 20M, 20C, and 20BK.

As shown in FIG. 1, the photoconductive drum 21 rotates in a clock-wise direction. The surface of the photoconductive drum 21 is uniformly charged by the charger 22, which charges the photoconductive drum 21 with a predetermined voltage. Then, the charged surface of the photoconductive drum 21 comes to a position, at which the surface of the photoconductive drum 21 is scanned by the laser beam "L."

For example, the laser beam "L" for yellow image, which is reflected by mirrors 6 to 8, scans the photoconductive drum 21 of the process cartridge 20Y. The laser beam "L" for yellow image is scanned in an axis direction (i.e., main scanning direction) of the photoconductive drum 21 by the polygon mirror 3 rotating at a high speed. Then, an electrostatic latent image corresponding to the yellow image is formed on the photoconductive drum 21. Similarly, the laser beam "L" for magenta image, which is reflected by mirrors 9 to 11, scans the photoconductive drum 21 of the process cartridges 20M, and an electrostatic latent image corresponding to the magenta image is formed on the photoconductive drum 21 of the process cartridge 20M. Similarly, the laser beam "L" for cyan image, which is reflected by the mirrors 12 to 14, scans the photoconductive drum 21 of the process cartridge 20C, and an electrostatic latent image corresponding to the cyan image is formed on the photoconductive drum 21 of the process cartridge 20C. Similarly, the laser beam "L" for black image, which is reflected by the mirror 15, scans the photoconductive drum 21 of the process cartridges 20BK, and an electrostatic latent image corresponding to the black image is formed on the photoconductive drum 21 of the process cartridges 20BK.

Then, the photoconductive drum 21 having the electrostatic latent image thereon comes to a position facing the developing unit 23. The developing unit 23 supplies toner particles to the photoconductive drum 21 to develop the electrostatic latent image as a toner image with the toner particles. Then, the photoconductive drum 21 having the toner image comes to a position facing the intermediate transfer belt 27. As shown in FIG. 1, the first transfer roller 24 is provided at a position, at which the first transfer roller 24 contacts an inner surface of the intermediate transfer belt 27. The first transfer roller 24 transfers the toner image to the intermediate transfer belt 27 from the photoconductive drum 21.

After transferring the toner image to the intermediate transfer belt 27, the photoconductive drum 21 comes to a position facing the drum-cleaning unit 25, which collects toner particles remaining on the photoconductive drum 21. Then, the photoconductive drum 21 is de-charged by a decharger (not shown), and an image forming process related to the photoconductive drum 21 completes.

The toner particles collected by the drum-cleaning unit 25 are re-used in a developing process as "recycled toner," which will be described in detail later.

The intermediate transfer belt 27 having received the toner image from the photoconductive drum 21 travels in a arrow direction "E" as shown in FIG. 1, and comes to a position facing the second transfer roller 28. The second transfer roller 28 transfers the toner image to the transfer member "P" from the intermediate transfer belt 27.

Then, the intermediate transfer belt 27 comes to a position facing the belt-cleaning unit 29. The belt-cleaning unit 29 collects toner particles remaining on the intermediate transfer belt 27, and an image forming process related to the intermediate transfer belt 27 completes.

The above-mentioned transfer member "P" is transported to a position, which faces the second transfer roller 28, from the sheet feeder 61 using a sheet-feed roller 62, a transport guide 63 and a registration roller 64. Specifically, the feed roller 62 feeds the transfer member "P" to the position of the registration roller 64 from the sheet feeder 61 through the transport guide 63. The registration roller 64 feeds the transfer member "P" to the position of the second transfer roller 28 while synchronizing a feed timing with the intermediate transfer belt 27 having the toner image. With such arrangement, the toner image is transferred to the transfer member "P."

The transfer member "P" having received the toner image is transported to the fixing unit 66 by the transport belt 30. The fixing unit 66 includes a heat roller 67 and a pressure roller 68, and an ejection roller 69. The fixing unit 66 fixes the toner images on the transfer member "P" by passing the transfer member "P" through a nip defined by the heat roller 67 and the pressure roller 68. Then, the transfer member "P" is ejected out of the image forming apparatus 1 through the ejection roller 69, and the image forming apparatus 1 completes an image forming operation.

Hereinafter, with reference to FIGS. 2 and 3, a process cartridge for use in the image forming apparatus 1 will be described in detail.

FIG. 2 is a vertical schematic sectional view of a process cartridge of the image forming apparatus 1, and FIG. 3 is a horizontal schematic sectional view of a process cartridge in FIG. 2.

Each of the process cartridges 20Y, 20M, 20C, and 20BK employs a similar configuration to one another except colors of toner "T" and "TN," and each of the toner bottles 32Y, 32M, 32C, and 32BK employs a similar structure except colors of the toner "T" and "TN." The toner "T" represents toner particles already supplied in the developing unit 23, and the toner "TN" represents toner particles stored in the toner bottle 32. Accordingly, for the sake of simplifying the explanation in this specification, the process cartridges 20Y, 20M, 20C, and 20BK are collectively referred as "process cartridges 20," and the toner bottles 32Y, 32M, 32C, and 32BK are collectively referred as "toner bottle 32," as required.

As shown in FIG. 2, the process cartridge 20 integrates the photoconductive drum 21, the charger 22, the developing unit 23, the drum-cleaning unit 25, and the conveying line 26.

The process cartridge 20 can be designed to be detached from the image forming apparatus 1.

The above-mentioned developing unit 23 includes a developing roller 23*a*, a first conveyor 23*b*, a second conveyor 23*c*, a doctor blade 23*d*, a separator 23*e*, and a first supply port 23*f*. As shown in FIG. 3, the developing roller 23*a* faces the photoconductive drum 21. The first conveyor 23*b* faces the developing roller 23*a*. The separator 23*e* is provided between the first conveyor 23*b* and the second conveyor 23*c*. The doctor blade 23*d* faces the developing roller 23*a*.

As shown in FIG. 3, the developing roller 23*a* includes a magnet 23*a*1 and a sleeve 23*a*2. The magnet 23*a*1 is disposed inside the developing roller 23*a* and forms a magnetic field around the developing roller 23*a*. The sleeve 23*a*2, which is rotatable, covers the magnet 23*a*1.

The developing unit 23 stores a two-component developer "G" having carrier particles "C" and toner particles "T." The developing unit 23 is connected to the toner bottle 32 via supply lines 34A and 34C as shown in FIG. 2. A new toner "TN" stored in the toner bottle 32 is supplied to the developing unit 23, as required. In one exemplary embodiment, the "TN" represents a toner particles stored in the toner bottle 32 (i.e. not used yet), and the "T" represents toner particles already supplied to the developing unit 23 and to be used as above-mentioned.

The drum-cleaning unit 25 includes a magnet roller 25*a*, a third conveyor 25*b*, a restrictor 25*c*, a cleaning blade 25*d*, and a second supply port 25*e* as shown in FIG. 2. The magnet roller 25*a* collects toner particles from the photoconductive drum 21. The restrictor 25*c* is spaced apart from the magnet roller 25*a*. The cleaning blade 25*d* contacts a surface of the photoconductive drum 21. The third conveyor 25*b* conveys toner particles "TR," collected in the cleaning unit 25, with a new developer "GN" to the conveying line 26. In one exemplary embodiment, the "GN" represents a two component developer having the toner "TN" and "CN" (representing a new carrier particles stored in the carrier bottle 33), which will be explained later. On one hand, "G" represents a two component developer having the toner particles "T" (i.e. toner particles supplied in the developing unit 23) and carrier "C" (i.e. carrier particles contained in the developing unit 23 in advance).

As shown in FIG. 3, the magnet roller 25*a* includes a magnet 25*a*1 and a sleeve 25*a*2. The magnet 25*a*1 is disposed inside the magnet roller 25*a* and forms a magnetic field around the magnet roller 25*a*. The sleeve 25*a*2, which is rotatable, covers the magnet 25*a*1.

The drum-cleaning unit 25 is connected to the carrier bottle 33 via the supply line 34B. The drum-cleaning unit 25 is also connected to the toner bottle 32 via the supply lines 34A and 34B. The new carrier "CN" stored in the carrier bottle 33 is mixed with the new toner "TN" supplied from the toner bottle 32 in the supply line 34B, and such mixture is supplied to the drum-cleaning unit 25 as the new developer "GN" as required. As described above, the new developer "GN" is supplied to the drum-cleaning unit 25 from the carrier bottle 33 and the toner bottle 32 via the supply lines 34A and 34B.

The above-mentioned supply lines 34A, 34B, and 34C include flexible tubes and two mohno-pumps (not shown) connected to the flexible tubes, for example. By controlling the two mohno-pumps independently, the new developer "GN" is supplied to the drum-cleaning unit 25 via the supply lines 34A and 34B, and the new toner "TN" is supplied to the developing unit 23 via the supply lines 34A and 34C. Instead of the mohno-pump, the supply lines 34A, 34B, and 34C can include an air pump using airflow or a mechanical conveyer such as spiral coil, for example.

As shown in FIG. 3, the conveying line 26 includes a conveyor 26*a* rotatably disposed inside the conveying line 26. The conveying line 26 is provided between the drum-cleaning unit 25 and the developing unit 23. Instead of the conveyor 26*a*, the conveying line 26 can employ other conveyer such as mohno-pump and air pump, for example. The third conveyor 25*b* mixingly conveys toner "TR" and the new developer "GN" from the drum-cleaning unit 25 to the developing unit 23. The toner "TR" represents toner particles which remain on the photoconductive drum 21 and to be collected in the drum-cleaning unit 25, hereinafter.

With reference to FIGS. 2 and 3, an image forming process and a recycling process in the process cartridge 20 will be explained hereinafter.

In the developing unit 23, the developer "G" moves from the first conveyor 23*b* to the developing roller 23*a* with a magnetic field formed around the developing roller 23*a*. With a rotation of the sleeve 23*a*2, the developer "G" on the developing roller 23*a* is carried to a position facing the doctor blade 23*d*. Such developer "G" is regulated at a doctor gap defined by the doctor blade 23*d* and the developing roller 23*a* so that an amount of the developer "G" is maintained at an appropriate level. After such regulation, the developer "G" having an appropriate amount is carried to a position facing the photoconductive drum 21, and is used for developing the electrostatic latent image formed on the photoconductive drum 21.

The developing roller 23*a* is applied with a developing bias voltage having direct current (DC) component. With such developing bias voltage, an electric field is formed between the developing roller 23*a* and the photoconductive drum 21 having the electrostatic latent image thereon so that the toner "T" in the developer "G" can be biased to the electrostatic latent image. Then, toner particles can be adhered to the electrostatic latent image on the photoconductive drum 21 to develop a toner image. After that, the developer "G" remaining on the developing roller 23*a* is separated from the developing roller 23*a* at a position in which a magnetic field line is not formed (not shown) on the developing roller 23*a*, and dropped to the first conveyor 23*b*. The above-described process is repeated for the developing roller 23*a*.

Most of the toner particles adhered to the photoconductive drum 21 are transferred to the intermediate transfer belt 27 during a transfer process. Toner particles not transferred to the intermediate transfer belt 27 (i.e. toner particles remaining on the photoconductive drum 21) are collected by the drum-cleaning unit 25 as the toner "TR." The toner "TR" is mixed with the new developer "GN" supplied from the toner bottle 32 and the carrier bottle 33, in the drum-cleaning unit 25, and such mixture becomes a two-component developer.

As shown in FIG. 3, the developer "G" in the developing unit 23 moves between a first compartment encasing the first conveyor 23*b*, and a second compartment encasing the second conveyor 23*c*, with the rotation of the first conveyor 23*b* and the second conveyor 23*c* in a predetermined direction (see the dotted line in FIG. 3), wherein the first compartment and the second compartment are separated by the separator 23*e*. Specifically, the developer "G" in the first compartment moves to the second compartment through a first opening hole 23*h* provided in the separator 23*e*. And the developer "G" in the second compartment moves to the first compartment through a second opening hole 23*g* provided in the separator 23*e*.

The conveying line 26, functioning as a recycle line for toner particles, is connected to one end portion of the second compartment encasing the second conveyor 23*c* as shown in FIG. 3. Via the conveying line 26, two-component developer containing the "recycled toner" (i.e. the toner "TR" mixed with the new developer "GN") is supplied to the developing unit 23 from the cleaning unit 25.

As shown in FIG. 3, a first toner concentration sensor 41, such as a magnetic permeability sensor or a reflection type photo-sensor, is provided in the developing unit 23 to detect toner concentration in the developing unit 23. As also shown in FIG. 3, a second toner concentration sensor 42, such as a magnetic permeability sensor or a reflection type photo-sensor, is provided at one end side of the conveying line 26, at which the conveying line 26 is connected to the drum-cleaning unit 25. The second toner concentration sensor 42 detects the toner concentration in the developer, which is conveyed in the conveying line 26, and transmits a detection result to a central processing unit (CPU), not shown, of the image forming apparatus 1. The CPU of the image forming apparatus 1 determines an amount of new toner "TN" to be supplied to the developing unit 23 based on the detection result of the second toner concentration sensor 42, a percentage of image-area to be printed on a sheet, and the detection result of the first toner concentration sensor 41. Then, the toner "TN" having an amount instructed by the CPU is supplied to the developing unit 23 from the toner bottle 32 via the supply lines 34A and 34C, and a first supply port 23*f*.

As shown in FIG. 3, the developing unit 23 further includes an ejection port 23*k* at one end portion of the first compartment encasing the first conveyor 23*b* to eject the developer "G" from the developing unit 23. Specifically, the ejection port 23*k* is provided at one end portion of the first conveyor 23*b* with a predetermined height from a bottom surface of the developing unit 23.

An amount of the developer "G" in the developing unit 23 increases when the developer "G" is supplied in the developing unit 23 via the conveying line 26. If the amount (i.e. height level) of the developer "G" surpasses the height of the ejection port 23*k*, the developer "G" is ejected via the ejection port 23*k*, wherein such method is called as "overflow method." The developer "G" can be ejected from the developing unit 23 in a direction shown by a dotted-line in FIG. 3, and then collected in a waste bottle (not shown), which is detachably provided in the image forming apparatus 1.

The developer "G" can be ejected from the developing unit 23 by other method such as "side face ejection method" or "magnetically-absorbed ejection method," wherein the "side face ejection method" ejects the developer "G" from a cut portion provided in a side face of the second compartment encasing the second conveyor 23*c*, and the "magnetically-absorbed ejection method" ejects the developer "G," which is adhered to a rotating magnet at first at an end portion of the first conveyor 23*b* and is then dropped from the rotating magnet by a centrifugal force, for example.

However, the "overflow method" is preferably used for removing paper powders, degraded toner particles, and free additives accumulated in the developer "G."

As shown in FIG. 3, the new developer "GN" (i.e. a mixture of the carrier particles and toner particles supplied from the carrier bottle 33 and the toner bottle 32), enters the drum-cleaning unit 25 via the second supply port 25*e* provided over one end side of the third conveyor 25*b*. The new developer "GN" is conveyed along the third conveyor 25*b* rotating in a predetermined direction shown by an arrow in FIG. 3, and further conveyed to a position connected to the conveying line 26. At this time, a portion of the new developer "GN," conveyed by the third conveyor 25*b*, is carried on the magnet roller 25*a*. Such new developer "GN" carried on the magnet roller 25*a* collects the toner "TR" from the photoconductive drum 21 when the magnet roller 25*a* comes to a position facing the photoconductive drum 21. Then such new developer "GN," which has collected the toner "TR," is returned back to the third conveyor 25*b* again.

In one exemplary embodiment, the toner "TR" remaining on the photoconductive drum 21 is collected by the drum-cleaning unit 25, then mixed with the new developer "GN" in the drum-cleaning unit 25, and conveyed to the developing unit 23 via the conveying line 26. As such, the toner "TR" having unstable charge property is mixed with the new developer "GN" including the new carrier "CN" having a higher CA, thereby the toner "TR" gains a favorable charge property before conveyed to the developing unit 23. Such recycled toner "TR" can be retained on the carrier "C" in the developing unit 23, thereby drawbacks such as toner particles scattering and background fogging can be reduced.

Typically, the developer "G" in the developing unit 23 gradually changes its property over time. The property of the developer "G" may be changed due to several factors such as peeling of a carrier coat layer from the carrier, toner melting and subsequent adhesion on the carrier particles surface, and a shift of additives to carrier particles from toner particles. In such cases, the CA of the carrier "C" may be degraded. The degraded CA of the carrier "C" may not be regained over time, which can result in a drawback such as toner particles spattering and background fogging. Therefore, a lifetime of the developer "G" may be set based on the CA value of the carrier, in general.

In one exemplary embodiment, the new carrier "CN" is supplied to the developing unit 23, as required, to eject the degraded carrier "C" so that the CA of the carrier "C" in the developing unit 23 can be maintained over time. With such an arrangement, image quality degradation such as toner particles spattering and background fogging can be prevented.

Hereinafter, an operation for collecting the toner "TR" remaining on the drum-cleaning unit 25 will be explained in detail. Specifically, the magnet roller 25*a* shown in FIG. 2 collects the toner "TR" remaining on the drum-cleaning unit 25 as below.

The magnet 25*a*1 disposed in the magnet roller 25*a* forms a plurality of magnetic fields above the surface of the magnet roller 25*a*. The new developer "GN" supplied to the drum-cleaning unit 25 is carried on the magnet roller 25*a* rotating in a direction shown by an arrow in FIG. 2 with an effect of magnetic field formed around the magnet roller 25*a*, and forms a magnetic brush. Then, the restrictor 25*c* regulates an amount of the new developer "GN" (i.e. magnetic brush) to be carried on the magnet roller 25*a*. The magnet roller 25*a* having such a regulated amount of the developer "GN" (i.e. magnetic brush) comes to a position facing the photoconductive drum 21. Such a magnetic brush formed on the magnet roller 25*a* approaches and brushes the surface of the photoconductive drum 21 with a first magnetic field formed around the magnet 25*a*1.

With such an arrangement, the toner "TR" remaining on the photoconductive drum 21 is removed from the photoconductive drum 21 and adheres on the new carrier "CN" electrostatistically and physically. Then such toner "TR" is carried on the magnet roller 25*a* with the new developer "GN." Then the toner "TR" and the new developer "GN" carried on the magnet roller 25*a* are separated from the magnet roller 25*a* at an upper side of the third conveyor 25*b* with a second magnetic field formed on the magnet 25*a*1.

A rotating direction of the magnet roller 25*a* is opposite with respect to a rotating direction of the photoconductive drum 21 at a position where the magnet roller 25*a* faces the photoconductive drum 21. Therefore, the number of brushing-contacts of the magnetic brush to the photoconductive drum 21 becomes relatively large, which results in an improvement in the collecting of the toner "TR."

After passing the position facing the magnet roller 25*a*, the surface of the photoconductive drum 21 comes to a position facing the cleaning blade 25*d*. Toner particles not removed by the magnet roller 25*a* are collected by the cleaning blade 25*d*, which contacts the surface of the photoconductive drum 21. The toner "TR" collected by the cleaning blade 25*d* drops to a downward direction by gravitational force, and is collected by the magnetic brush on the magnet roller 25*a*, disposed under the cleaning blade 25*d*.

The magnet roller 25*a* is applied with a DC (direct current)-bias voltage superimposed with AC (alternative current)-bias voltage by a power source (not shown) to improve a collection efficiency of the toner "TR."

The surface of the sleeve 25*a*2 of the magnet roller 25*a* is provided with V-shaped grooves in a radial direction for transportability of the magnetic brush on the sleeve 25*a*2. If the transportability of the magnetic brush on the sleeve 25*a*2 can be properly attained, a sand-blasting can be conducted on the surface of the sleeve 25*a*2 instead of the V-shaped grooves.

In one exemplary embodiment, the new developer "GN" is supplied from the second supply port 25*e* to the third conveyor 25*b*. However, although not shown, the new developer "GN" can be supplied directly to the magnet roller 25*a* from an upper side of the magnet roller 25*a*, for example. The toner "T" in the developer "G" and the new toner "TN," supplied to the developing unit 23 and the drum-cleaning unit 25, are similar to each other and prepared as below. The toner "T" and "TN" for use in one exemplary embodiment are polymerized spherical toner particles, which are prepared by a polymerization method using a polymerization reaction, such as a polyaddition reaction.

At first, a colorant (such as pigments), a polyester prepolymer having a isocyanate group, and other additives such as release agents, charge controlling agents and the like are dissolved or dispersed in a volatile organic solvent to prepare a toner constituent mixture liquid (e.g., an oil phase liquid). Then, the toner constituent mixture liquid is emulsified in an aqueous medium with a presence of inorganic fine particles and polymer fine particles. A suitable aqueous medium includes water. Then, the polyester prepolymer having an isocyanate group is reacted with a poly-amine and/or mono-amine having an active hydrogen atom to obtain an urea modified polyester resin having an urea group.

The toner "T" (and "TN") is obtained by removing a liquid medium from a dispersant including the urea modified polyester resin. The urea modified polyester resin for use in the toner of the one embodiment preferably has a glass transition temperature (Tg) of from 40 to 65° C., and more preferably from 45 to 60° C. A number average molecular weight (Mn) of the urea modified polyester resin is generally from 2,500 to 50,000, and preferably from 2,500 to 30,000. An average molecular weight (Mw) of the urea modified polyester resin is generally from 10,000 to 500,000, and preferably from 30,000 to 100,000.

The toner "T" (and "TN") includes the urea modified polyester resin, prepared from a reaction of the above-mentioned polyester prepolymer and the above-mentioned mono-amine, as a binder resin. The binder resin includes colorant, which disperses in the binder resin. The toner particles for use in one exemplary embodiment include at least the binding resin, and the release agent and the colorant, which are insoluble to the binding resin. By mixing the binding resin and the colorant in an organic solvent at first, the colorant can be effectively adhered on the binding resin.

With such a process, the colorant can be effectively dispersed in the binding resin with a smaller diameter for the dispersed colorant. Accordingly, the colorant can be finely dispersed in the toner "T" and "TN," thereby the toner "T" and "TN" have preferable properties in tinting power, color tone, and transparency, for example. With such toner "T" and "TN," a higher quality image having favorable property in transparency, chroma such as brightness and gloss, and color reproducibility can be produced by the image forming apparatus 1.

In one example embodiment, the polymerized spherical toner particles, prepared by a polymerization method, are used as the toner "T" and "TN" to improve the above-mentioned image quality. However, toner particles prepared by a grinding method can also be used as the toner "T" and "TN."

The toner "T" and "TN" for use in one example embodiment preferably have a volume average particle diameter (Dv) of from 4.0 to 8.0 μm, and a ratio (Dv/Dn) (i.e. a ratio of the volume average particle diameter (Dv) to the number average particle diameter (Dn)) of from 1.00 to 1.25. By regulating the Dv/Dn ratio within the above-mentioned range, a toner "T" and "TN" can be obtained that produce a higher resolution image and a higher quality image. To obtain a high quality image, the colorant for use in one exemplary embodiment preferably has a volume average particle diameter (Dv) of from 4.0 to 8.0 μm, and a ratio (Dv/Dn) of from 1.00 to 1.25, and the number percentage of the particle having a diameter of 3.0 μm or less is preferably set to 1.0 to 10%. More preferably, the colorant preferably has a volume average particle diameter (Dv) of from 4.0 to 6.0 μm, and a ratio (Dv/Dn) of from 1.00 to 1.15.

The toner "T" and "TN" prepared in the above-described manner have favorable properties in heat resistance, low temperature fixability, and hot-offset resistance. Specifically, when the above-mentioned toner "T" and "TN" are used in a color image forming apparatus, a printed image has a favorable property in gloss.

Furthermore, even if toner particles are consumed and supplied to the two-component developer over a long period, toner diameter distribution in the developer becomes smaller. Accordingly, a stable and good developability can be obtained even if the two-component developer is agitated in the developing unit 23 over a long period.

The toner "T" and "TN" preferably have an average circularity of 0.90 to 1.0. As expressed in the formula below, the circularity of toner particle is defined as the ratio between the circumference of a circle having equivalent area (defined as "equivalent circle circumference") of the toner particle and the perimeter of the toner particle (defined as "particle perimeter"), Circularity=(Equivalent circle circumference)/(Particle perimeter), where the toner particle is optically projected to a plane for measurement of the circularity. The more spherical the particle, the closer its circularity is to 1.00. The more elongated the particle, the lower its circularity.

In particular, the average circularity of toner can be measured using a flow particle image analyzer FPIA-2000 manufactured by SYSMEX Co., Ltd.

If the toner particles have an average circularity of less than 0.90, the toner particles may have irregular shapes (i.e. less spherical shapes), thereby a transferability of the toner particles may deteriorate, and result in an image having less favorable quality such as taint. An irregular-shaped toner particle has a relatively large number of contact points that contact the photoconductive drum 21, and furthermore, a charge of the toner particles concentrates on such contact points (e.g., an end of a protruded portion). Therefore, such irregular-shaped toner particles have higher van der Walls forces and electrostatic image forces than toner particles having a higher circularity.

If toner particles are a mixture of irregular-shaped toner particles and spherical toner particles, the spherical toner particles may selectively transfer from the photoconductive drum 21 to the intermediate transfer belt 27 during a transfer process, and result in a void image at character image area and line image area, for example. Furthermore, a toner yield (i.e. a percentage of toner particles actually used for image forming) may become smaller.

The toner "T" (and "TN") prepared by the grinding method may have an average circularity of 0.91 to 0.92, in general. To obtain toner particles having a higher average circularity (i.e. closer to 1.00), an emulsifying polymerization method, a suspension polymerization method, a dispersing polymerization method can be applied instead of the above-mentioned polymerization method.

The toner "T" and "TN" for use in one exemplary embodiment are preferably added with silica of 0.7 part and titanium oxide of 0.3 part as additives on a surface of the toner "T" and "TN," wherein the term "part" represents a weight ratio. To reduce adhesiveness of the toner particles to the carrier particles for an improvement of developing efficiency, silica of 1 part or more may be added to the surface of toner particles to improve fluidity of the toner particles. However, if the toner particles having silica of relatively larger amount are used, the toner particles may change its property such as charge property against environmental conditions in a less favorable manner, and the magnetic carrier particles may not be supplied to the developing roller 23 with a proper amount. Therefore, the above-mentioned silica of 0.7 part and titanium oxide of 0.3 part are used as the additives, for example.

The developing roller 23*a*, which carries the developer including the above-mentioned toner particles, is applied with a developing bias voltage having a DC (direct current) component as above explained.

If the new developer "GN" is not supplied to the developing unit 23, an adhesiveness of the toner to the carrier changes greatly over time. In such a case, an image having less granular quality can be obtained at first because the toner particles have a smaller adhesiveness at first, but an image having significantly higher granular quality may be obtained over time because the toner particles may increase its adhesiveness over time.

In one exemplary embodiment, the new developer "GN" is supplied to the developing unit 23, as required, the degraded developer "G" is ejected out of the developing unit 23, and the developing bias voltage having DC (direct current) component is applied to the developing roller 23*a*. Therefore, an electrical stress to be given to the carrier "C" at a developing area can be reduced, and a high quality image having less granular quality can be obtained.

In one exemplary embodiment, a developing potential of a low electric field is formed at the developing area. Specifically, the image forming apparatus 1 is configured to set a charge potential "VD" of "−350 Volts" on the photoconductive drum 21 for a charging process, an electrostatic latent image potential "VL" of "−50 Volts" for an exposing process, and a developing bias voltage "VB" of "−250 Volts" for a developing process, for example. That is, the developing potential of "VL-VB" is set 15 to 200 Volts, for example.

In this case, a relation of "$0<|VD|-|VB|<|VD-VL|<400$ Volts" can be established. The relation of "$|VD-VL|<400$ Volts" is set to prevent an electric discharge between an image area and a non-image area on the photoconductive drum 21 using Paschen's law.

In one exemplary embodiment, an image forming process uses a negative-positive process for image forming.

Hereinafter, an effect according to one exemplary embodiment will be explained with reference to FIG. 4, which shows a result of an experiment described as below.

Figure 4:
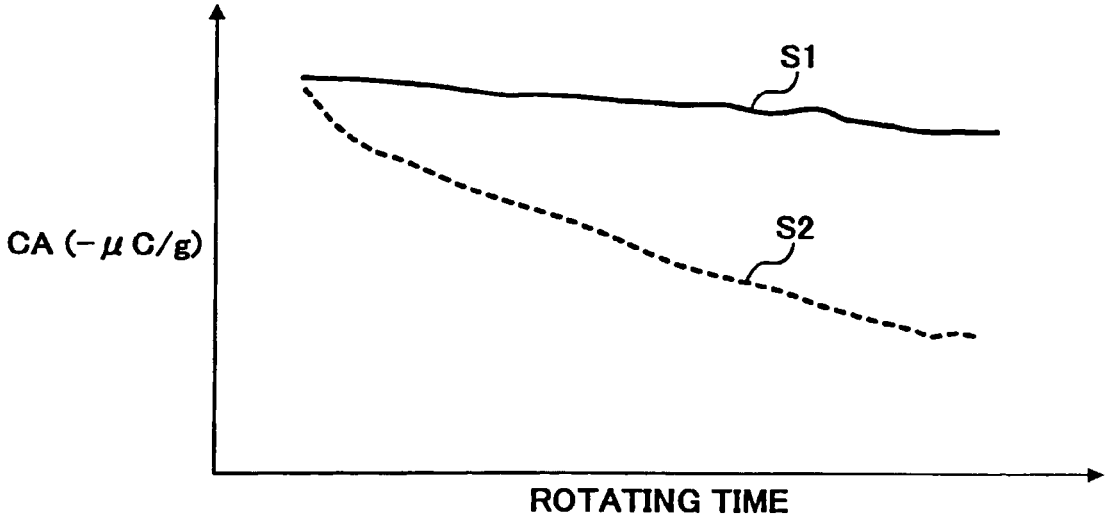
FIG. 4 is a graph for CA (i.e., charge-ability) of carrier particles as a function of time in a developing unit.

In FIG. 4, the horizontal axis represents a rotating time of the photoconductive drum 21 (i.e. an operating time of the process cartridge 20 for image forming), and the vertical axis represents the CA of the carrier "C" in the developing unit 23. FIG. 4 shows a change of the CA as a function of time, where a solid line "S1" represents a case that the image forming apparatus according to one exemplary embodiment is used, in which the new carrier "CN" is supplied from the conveying line 26 to the developing unit 23, and a dotted line "S2" represents a case of using another image forming apparatus without installing the toner bottles 32, the carrier bottle 33, and the supply lines 34*a*, 34*b*, and 34*c* of the above-described exemplary embodiment.

The toner bottles 32, the carrier bottle 33, and the supply line 34*a*, 34*b*, and 34*c* are collectively referred as supplying units 32, 33, and 34, as required.

The image forming apparatus for the solid line "S1," and another image forming apparatus for the dotted line "S2" employ similar configurations and conditions except the supplying units 32, 33, and 34. For example, as for developing conditions, a developing bias voltage having a predetermined DC component is applied, and an amount of toner particles adhered in a solid-image area after the developing process is adjusted to 0.5 mg/cm.sup.2.

A diameter of the photoconductive drum 21 is set to 90 mm, a sleeve diameter of the a developing roller 23*a* is set to 25 mm, and a developing gap defined by the photoconductive drum 21 and the developing roller 23*a* is set to 0.3 mm, for example. An image-occupying ratio on a printed sheet, produced by the image forming apparatus 1, is set to 20%, for example.

A recycling process according to one exemplary embodiment mixes the toner "TR" with the new developer "GN" and conveys such mixture to the developing unit 23, where an effect of such recycling process is shown in FIG. 4 as the solid line S1.

As shown in the solid line "S1" in FIG. 4, the CA of the carrier "C" in the developing unit 23 changes a little over time.

In a comparison experiment represented by the dotted line S2, another image forming apparatus is configured to mix the toner "TR" (i.e., "recycled toner") directly to the developer "G" in the developing unit 23, which resulted in toner particles spattering and background fogging.

In the experiment represented by the solid line "S1," the image forming apparatus is configured to mix the toner "TR" with the new developer "GN" in the cleaning unit 25, and such mixture is mixed with the developer "G" in the developing unit 23 as "recycled toner," which resulted in no toner particles pattering and background fogging.

Furthermore, a granular quality in an output image was evaluated and the result shows that a granular quality in an image output from the image forming apparatus, which is represented by the solid line S1, is confirmed to be in a favorable condition.

As described above, the image forming apparatus 1 according to the exemplary embodiment is configured to mix the toner "TR" with the new developer "GN" having the new carrier "CN" in the drum-cleaning unit 25, and to convey the toner "TR" and the new developer "GN" to the developing unit 23. With such an arrangement, a charge property of the toner "TR" used as "recycled toner" and conveyed to the developing unit 23, can be stabilized, and a degradation of the carrier "C" in the developing unit 23 can be prevented. Accordingly, image quality degradation such as toner particles spattering, background fogging, and unfavorable granular quality may not happen over time, and a toner recycling in the image forming apparatus 1 can be favorably achieved.

In one embodiment, the new developer "GN" having the new carrier "CN" and the new toner "TN" is supplied to the drum-cleaning unit 25 via the supply units 32, 33, and 34. Furthermore, the drum-cleaning unit 25 can be configured to be supplied with only the new carrier "CN" by modifying the supply units 32, 33, and 34. In this case, the new carrier "CN" is supplied to the drum-cleaning unit 25, and carried by the magnet roller 25*a* so that the new carrier "CN" may collect the toner "TR" similarly as in the above-described exemplary embodiment. And then, the toner "TR" and the new carrier "CN" are conveyed to the developing unit 23 via the conveying line 26. As in the above-described embodiment, a similar effect explained with FIG. 4 can be obtained for such modified image forming apparatus.

Hereinafter, another image forming apparatus according to another exemplary embodiment will be explained in detail with reference to FIG. 5.

Figure 5:
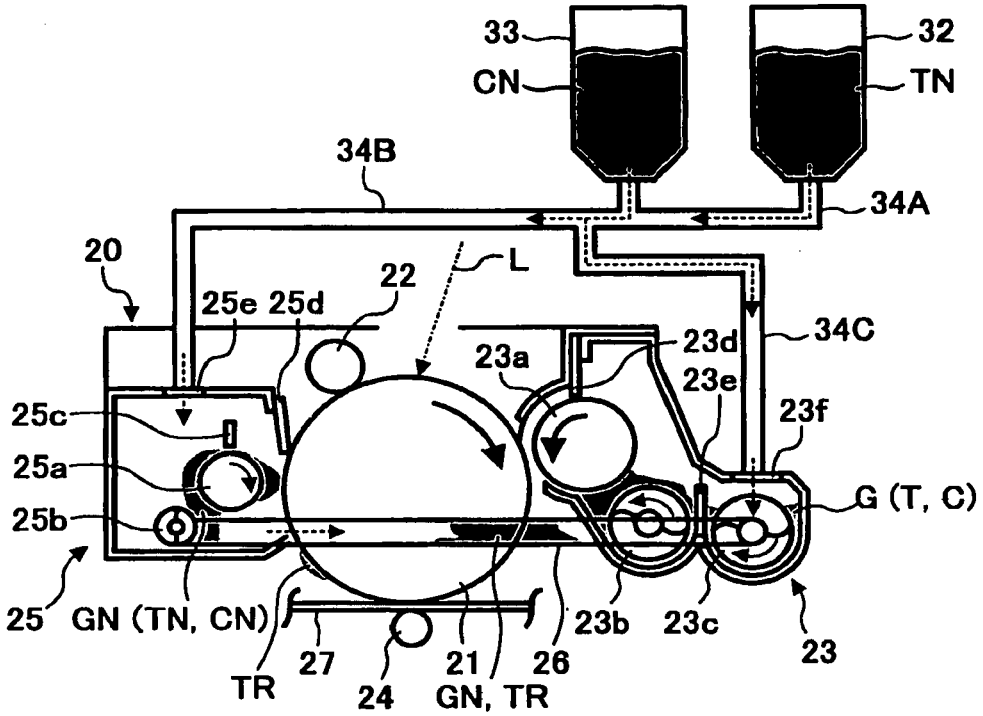
FIG. 5 is a schematic sectional view of another process cartridge of an image forming apparatus according to the present invention.

FIG. 5 shows a schematic sectional view of a process cartridge of an image forming apparatus according to another exemplary embodiment, which is comparable with the image forming apparatus in FIG. 2.

As shown in FIG. 5, the image forming apparatus is configured to supply the new carrier "CN" directly to both of the drum-cleaning unit 25 and the developing unit 23. On the contrary, the image forming apparatus in FIG. 2 is configured to supply the new carrier "CN" only to the drum-cleaning unit 25.

As shown in FIG. 5, the drum-cleaning unit 25 is connected to the carrier bottle 33 via the supply line 34B, which is similar to the drum-cleaning unit 25 in FIG. 2. The drum-cleaning unit 25 in FIG. 3 is further connected to the toner bottle 32 via the supply lines 34A and 34B. The new carrier "CN" supplied from the carrier bottle 33 is mixed with the new toner "TN" supplied from the toner bottle 32, and such mixture is supplied to the drum-cleaning unit 25 as the new developer "GN" as required.

As shown in FIG. 5, the developing unit 23 is connected to the toner bottle 32 via the supply lines 34A, 34B, and 34C. The developing unit 23 is further connected to the carrier bottle 33 via the supply lines 34B and 34C. With such arrangement, the new toner "TN" is supplied to the developing unit 23 from the toner bottle 32, as required. Furthermore, the new carrier "CN" is supplied to the developing unit 23 from the carrier bottle 33, as required.

As in one example embodiment in FIG. 2, the supply lines 34A, 34B, and 34C include a flexible tube and two mohno-pumps connected to the flexible tubes, for example. Furthermore, each of the toner bottle 32 and the carrier bottle 33 is provided with a shutter at an ejection port of the toner bottle 32 and the carrier bottle 33 to open and close the ejection port.

With such an arrangement, a first mode for supplying the new toner "TN" to the developing unit 23, a second mode for supplying the new developer "GN" to the developing unit 23, and a third mode for supplying the new developer "GN" to the drum-cleaning unit 25 can be discretionally controlled in the supply lines 34A, 34B, and 34C. When the second toner concentration sensor 42 detects a higher concentration of the toner "TR" in the developer "G" in the drum-cleaning unit 25, the third conveyor 25*b* and the conveyor 26*a* in the conveying line 26 is activated for rotation, and convey the developer "GN" including the toner "TR" to the developing unit 23.

In the embodiment of FIG. 5, the new carrier "CN" is controllably supplied to the drum-cleaning unit 25 and the developing unit 23 while changing a distribution amount of new carrier "CN" between the drum-cleaning unit 25 and the developing unit 23. For example, assume a case that the image forming apparatus 1 is sequentially outputting sheets having a smaller image-area. In this case, an amount of the toner "TR" remaining on the photoconductive drum 21 may become smaller. When the amount of the toner "TR" collected in the drum-cleaning unit 25 becomes smaller, an amount of the new carrier "CN" conveyed to the developing unit 23 with the toner "TR" may also become smaller. In such condition, to facilitate an ejection of the carrier "C" degraded in the developing unit 23, the new developer "GN" may be directly supplied to the developing unit 23 via the supplying unit 32, 33, and 34. With such controlling, a degradation of the CA of the carrier "C" in the developing unit 23 can be prevented regardless of the image-area on the sheets.

As explained above, in the embodiment of FIG. 5, a charge property of the toner "TR," used as "recycled toner" and conveyed to the developing unit 23, can be stabilized, and a degradation of the carrier "C" in the developing unit 23 can be prevented. Accordingly, image quality degradation such as toner particles spattering, background fogging, and unfavorable granular quality may not happen over time, and a toner recycling in the image forming apparatus can be favorably achieved.

Hereinafter, another image forming apparatus according to another exemplary embodiment will be explained in detail with reference to FIG. 6.

Figure 6:
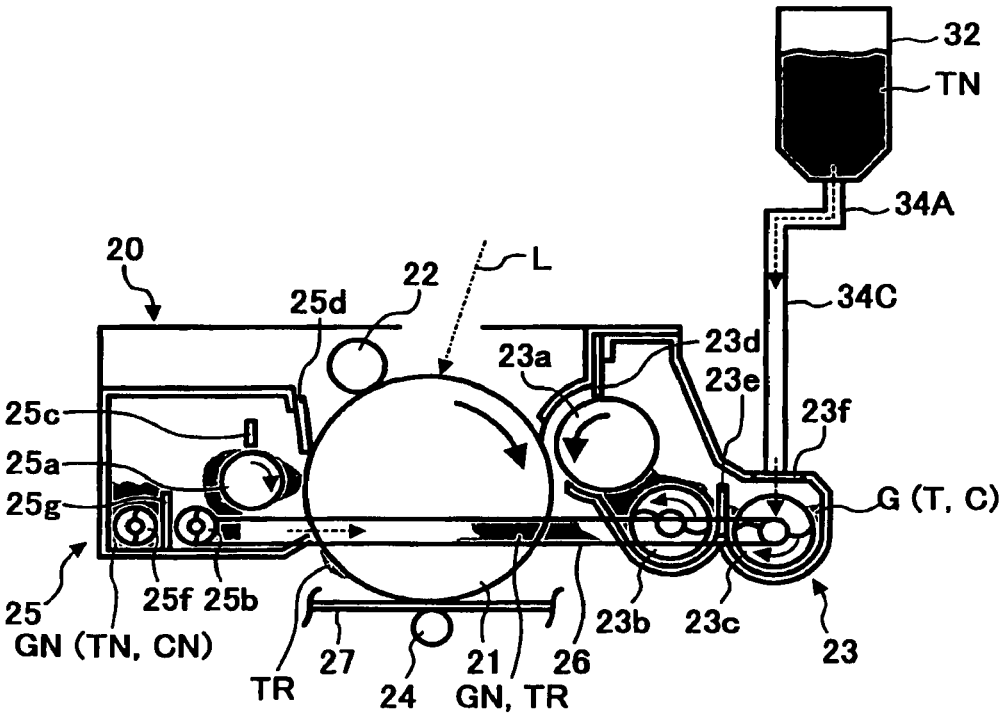
FIG. 6 is a schematic sectional view of another process cartridge of an image forming apparatus according to the present invention.

FIG. 6 shows a schematic sectional view of a process cartridge of an image forming apparatus according to another exemplary embodiment, which is comparable with the image forming apparatus in FIG. 2.

As shown in FIG. 6, the image forming apparatus is configured to supply the new developer "GN" to the drum-cleaning unit 25 by providing a fourth conveyor 25*f* and a separation member 25*g* inside the drum-cleaning unit 25. On the contrary, the image forming apparatus in FIG. 2 is configured to supply the new developer "GN" to the drum-cleaning unit 25 from the supplying unit 32, 33, and 34, provided outside of the drum-cleaning unit 25.

As shown in FIG. 6, the image forming apparatus is not provided with the carrier bottle 33, which contains the new carrier "CN". In the embodiment of FIG. 6, the new developer "GN" is stored in an area close to the magnet roller 25*a* and the third conveyor 25*b* in the drum-cleaning unit 25. Furthermore, a storing space provided by the separation member 25*g* stores a relatively large amount of new developer "GN" in advance. In the storing space storing the new developer "GN", the fourth conveyor 25*f* is provided. The drum-cleaning unit 25 can store the new carrier "CN" in the storing space in advance instead of the new developer "GN".

When the toner concentration of the toner "TR" in the drum-cleaning unit 25 becomes higher, the third conveyor 25*b* and the conveyor 26*a* in the conveying line 26 is activated for rotation, and convey the developer including the toner "TR" to the developing unit 23. At the same time, the fourth conveyor 25*f* in the storing space is activated for rotation, and supplies the new developer "GN" stored in the storing space to a space including the magnet roller 25*a*.

As explained above, in the embodiment in FIG. 6, a charge property of the toner "TR," used as "recycled toner" and conveyed to the developing unit 23, can be stabilized, and a degradation of the carrier "C" in the developing unit 23 can be prevented. Accordingly, image quality degradation such as toner particles spattering, background fogging, and unfavorable granular quality may not happen over time, and a toner recycling in the image forming apparatus can be favorably achieved.

Specifically, a configuration of FIG. 6 is preferable when a lifetime of the process cartridge 20 is set to a relatively shorter period. In this case, the above-described effect explained with reference to FIG. 4 can be obtained with a relatively simple manner and smaller cost.

Hereinafter, an image forming apparatus according to another exemplary embodiment will be explained in detail with reference to FIG. 7.

Figure 7:
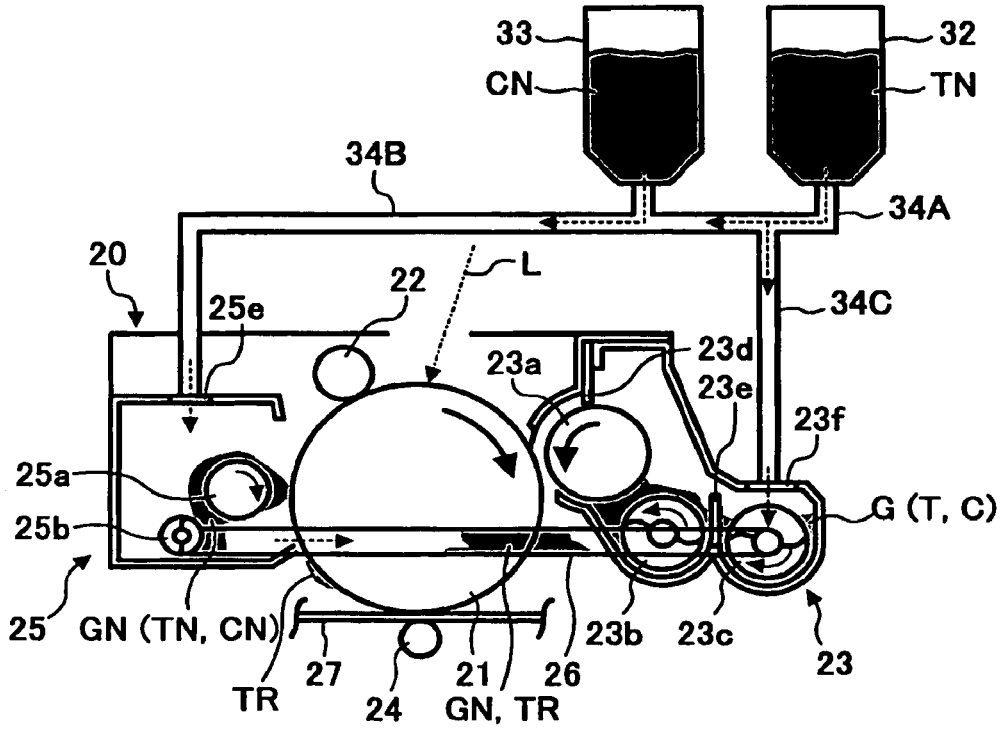
FIG. 7 is a schematic sectional view of another process cartridge of an image forming apparatus according to the present invention.

FIG. 7 shows a schematic sectional view of a process cartridge of an image forming apparatus according to another exemplary embodiment, which is comparable with the image forming apparatus in FIG. 2.

As shown in FIG. 7, the image forming apparatus is not provided with the cleaning blade 25*d* and the restrictor 25*c* in the drum-cleaning unit 25, which is different from the image forming apparatus in FIG. 2. The drum-cleaning unit 25 in FIG. 7 includes the magnet roller 25*a* and the third conveyor 25*b*. In a configuration of FIG. 7 not provided with the cleaning blade 25*d*, the toner "TR" on the photoconductive drum 21 is collected only by the magnet roller 25*a*. Such a configuration is useful for an image forming apparatus configured to transfer an image with a higher efficiency (i.e. an amount of the toner "TR" is small).

Specifically, when the above-mentioned polymerized spherical toner particles, having a Dv/Dn of from 1.00 to 1.25 and average circularity of from 0.90 to 1.00, is used for a developing process, the drum-cleaning unit 25 of FIG. 7 can function at a substantially similar manner of the drum-cleaning unit 25 of FIG. 2. The spherical toner particles can be collected more efficiently by the magnetic brush compared to the cleaning blade. The polymerized spherical toner particles can be collected more efficiently by increasing a blade pressure of the cleaning blade, or by increasing an number of cleaning blades. However, such configurations may degrade the collected toner particles. Accordingly, the configuration of FIG. 7 is preferable for the image forming process using spherical toner particles.

In the embodiment of FIG. 7, the restrictor 25*c*, which restricts the amount of the new developer "GN" carried on the magnet roller 25*a*, is not provided. In such an arrangement, the new developer "GN" on the magnet roller 25*a* can be adjusted to an adequate amount over time when the toner concentration increases. Specifically, an increase of the toner concentration in the developer "GN" leads to a lower magnetic field for carrying the developer "GN" on the magnet roller 25*a*, and resulting into a dropping of a portion of the developer "GN" from the magnet roller 25*a*, rotating in a predetermined direction. Accordingly, even without the restrictor 25*c*, the amount of the developer "GN" on the magnet roller 25*a* can be maintained at a certain level.

As explained above, in the exemplary embodiment of FIG. 7, a charge property of the toner "TR," used as "recycled toner" and conveyed to the developing unit 23, can be stabilized, and a degradation of the carrier "C" in the developing unit 23 can be prevented. Accordingly, image quality degradation such as toner particles spattering, background fogging, and unfavorable granular quality may not happen over time, and a toner recycling in the image forming apparatus can be favorably achieved.

Hereinafter, an image forming apparatus according to another exemplary embodiment will be explained in detail with reference to FIG. 8.

Figure 8:
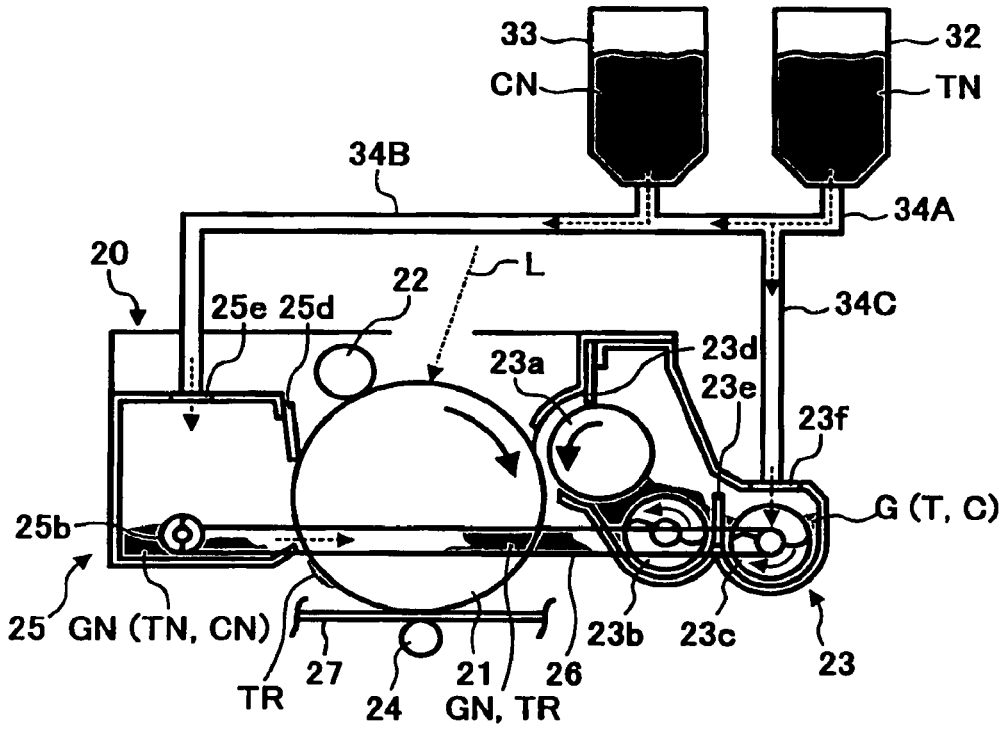
FIG. 8 is a schematic sectional view of another process cartridge of an image forming apparatus according to the present invention.

FIG. 8 shows a schematic sectional view of a process cartridge of an image forming apparatus according to another exemplary embodiment, which is comparable with the image forming apparatus in FIG. 2.

As shown in FIG. 8, the image forming apparatus is not provided with the magnet roller 25*a* and the restrictor 25*c* in the drum-cleaning unit 25, which is different from the image forming apparatus in FIG. 2. The drum-cleaning unit 25 in FIG. 8 includes the cleaning blade 25*d* and the third conveyor 25*b*.

In the configuration in FIG. 8, the toner "TR" on the photoconductive drum 21 is collected only by the cleaning blade 25*d* in the drum-cleaning unit 25. The toner "TR" scraped from the surface of the photoconductive drum 21 by the cleaning blade 25*d* drops on the third conveyor 25*b*. The dropped toner "TR" is mixed with the new developer "GN" by the third conveyor 25*b*, and conveyed to the developing unit 23 via the conveying line 26.

As explained above, in the exemplary embodiment of FIG. 8, a charge property of the toner "TR," used as "recycled toner" and conveyed to the developing unit 23, can be stabilized, and a degradation of the carrier "C" in the developing unit 23 can be prevented. Accordingly, image quality degradation such as toner particles spattering, background fogging, and unfavorable granular quality may not happen over time, and a toner recycling in the image forming apparatus can be favorably achieved.

In the above-described embodiments, the process cartridge 20 integrates the photoconductive drum 21 with at least one of the charger 22, the developing unit 23, the drum-cleaning unit 25, and the conveying line 26. However, the toner bottle 32, the carrier bottle 33, the supply lines 34A, 34B, and 34C provided separately from the process cartridge 20 in the above-described embodiments can be integrated with the photoconductive drum 21, the charger 22, the developing unit 23, the drum-cleaning unit 25, and the conveying line 26 in a process cartridge (not shown). Such a modified process cartridge can also realize a similar effect as in the process cartridge 20 explained in the above-described embodiments.

FIGS. 1, 2, 5, 7, and 8 show configurations in which a carrier bottle 33 is provided for each process cartridge 20 provided in the image forming apparatus 1. In other words, four carrier bottles 33 are provided in the image forming apparatus 1 in these configurations. However, although not shown in the drawings, the image forming apparatus 1 can also have a configuration providing one common carrier bottle 33 for a plurality of process cartridges 20. In such a case, each of the process cartridges 20 receives the carrier particles from the one common carrier bottle 33. Such a modified configuration can also realize a similar effect as in the process cartridge 20 explained in the above-described embodiments.

The process cartridge 20 can attain a longer lifetime by recycling the toner "TR" and supplying the new developer "GN" as described above.

Furthermore, each of the units such as the photoconductive drum 21, the charger 22, the developing unit 23, the drum-cleaning unit 25, and the conveying line 26 can be independently and detachably provided to the image forming apparatus 1 instead of integrating such units as the process cartridge 20. Specifically, a developing unit having the developing unit 23, a cleaning unit having the drum-cleaning unit 25 can be detachably provided to the image forming apparatus 1. Such configuration can also attain a similar effect as in the above-described embodiments.

When an independent developing unit is used, the developing roller 23*a* can be easily disengaged from the photoconductive drum 21 during a non-developing process, therefore toner filming on the developing roller 23*a* can be prevented and a longer lifetime of the developing unit 23 can be attained.

In the above-described example embodiments, the toner "TR" remaining on the photoconductive drum 21 is collected by the drum-cleaning unit 25, and is mixed with the new developer "GN" and conveyed to the developing unit 23 as "recycled toner." Similarly, toner particles remaining on the intermediate transfer belt 27 can be collected by the belt-cleaning unit 29, and such toner particles can be mixed with the new developer "GN" and conveyed to the developing unit 23 as "recycled toner."

The above-described embodiments can be applied to an image forming apparatus for producing color image and monochrome image, and can prevent image quality degradation such as toner particles spattering effectively for the image forming apparatus for producing color images and monochrome images.

Numerous additional modifications and variations are possible in light of the above teachings. It is therefore to be understood that within the scope of the appended claims, the disclosure of the present invention may be practiced otherwise than as specifically described herein.

The invention claimed is:

1. An image forming apparatus comprising:

a first developer including toner particles and carrier particles;

an image carrying member configured to form an electrostatic latent image thereon;

a developing unit configured to contain the first developer and to develop the electrostatic latent image as a toner image with the toner particles; a transfer unit configured to transfer the toner image;

a cleaning unit containing a second developer in a storing space thereof, the second developer including unused toner particles and unused carrier particles, in advance and to mix the second developer with the toner particles collected from the image carrying member after transferring the toner image, the cleaning unit including a conveyor disposed in the storing space which includes the second developer;

a conveying unit provided between the cleaning unit and the developing unit, the conveying unit being configured to convey a mixture of the collected toner particles and the second developer to the developing unit; and a second conveyor in the cleaning unit which conveys the second developer which was stored in the storing space to the conveying unit.

2. The image forming apparatus according to claim 1, further comprising a supply mechanism configured to supply the first developer to the developing unit.

3. The image forming apparatus according to claim 1, wherein:

a second conveyor and the conveying unit are activated when a concentration of toner in the cleaning unit is increased.

4. The image forming apparatus according to claim 1, wherein the cleaning unit further comprises:

a magnetic roller which attracts particles on the image carrying member.

5. The image forming apparatus according to claim 4, further comprising:

a developer supplying unit which includes the first developer and is external to the developing unit.

6. A process cartridge detachably provided in an image forming apparatus, said process cartridge comprising:

a first developer including toner particles and carrier particles;

an image carrying member configured to form an electrostatic latent image thereon; a developing unit configured to contain the first developer and to develop the electrostatic latent image as a toner image with the toner particles;

a cleaning unit containing a second developer in a storing space thereof, the second developer including unused toner particles and unused carrier particles, in advance and to mix the second developer with the toner particles collected from the image carrying member after transferring the toner image, the cleaning unit including a conveyor disposed in the storing space which includes the second developer;

a conveying unit provided between the cleaning unit and the developing unit, the conveying unit being configured to convey a mixture of the collected toner particles and the second developer from the cleaning unit to the developing unit; and a second conveyor in the cleaning unit which conveys the second developer which was stored in the storing space to the conveying unit.

7. The process cartridge according to claim 6, wherein the first developer is supplied to the developing unit by a supplying mechanism.

8. The process cartridge according to claim 7, further comprising the supply mechanism.

9. The process cartridge according to claim 6, wherein:

a second conveyor and the conveying unit are activated when a concentration of toner in the cleaning unit is increased.

10. The process cartridge according to claim 6, wherein the cleaning unit further comprising:

a magnetic roller which attracts particles on the image carrying member.

11. The process cartridge according to claim 10, further comprising:

a developer supplying unit which includes the first developer and is external to the developing unit.

* * * * *